US005830320A

United States Patent [19]

Park et al.

[11] Patent Number: 5,830,320

[45] Date of Patent: Nov. 3, 1998

[54] METHOD OF ENHANCING STRENGTH OF PAPER PRODUCTS AND THE RESULTING PRODUCTS

[75] Inventors: David W. Park, Puyallup; Frank R. Hunter, Bellevue, both of Wash.

[73] Assignee: Weyerhaeuser Company, Tacoma, Wash.

[21] Appl. No.: 718,103

[22] Filed: Sep. 18, 1996

[51] Int. Cl.[6] ..... D21H 23/04

[52] U.S. Cl. ..... 162/164.1; 162/164.3; 162/164.6; 162/166; 162/167; 162/182; 162/183

[58] Field of Search ..... 162/182, 183, 162/164.1, 164.3, 164.6, 165, 166, 167

[56] References Cited

U.S. PATENT DOCUMENTS

| | | | |
|---|---|---|---|
| 3,151,017 | 9/1964 | Brafford | 162/183 |
| 3,998,690 | 12/1976 | Lyness et al. | 162/183 |

OTHER PUBLICATIONS

M.K. Gupta, "Chemically Modified Fiber as a Novel Sizing Material," Tappi (Mar. 1980) vol. 63, No. 3, pp. 29–31.

Stratton, Robert A. Dependence of sheet properties on location of absorbed polymer. Nordic Pulp and Paper Res. J. 4(2) 104–112 (1989).

*Primary Examiner*—Peter Chin

[57] ABSTRACT

The invention is a method of enhancing the strength of paper products, particularly the dry strength, without adversely affecting repulpability. It is also directed to the resulting products. It is particularly applicable but not limited to products with significant amounts of secondary fiber in the furnish. Preferably, about 10–30% of the fiber is separated from the furnish at some point prior to sheeting. This is treated with a cationic wet strength resin which is allowed to bond to the fiber. Cationic polyamide-epichlorohydrin resins are particularly useful. The treated fiber is them mixed with the untreated balance of the fiber at some point before the paper machine. Screnning fines on repulping do not normally exceed 2–3%.

18 Claims, 4 Drawing Sheets

METHOD OF ENHANCING STRENGTH OF PAPER PRODUCTS AND THE RESULTING PRODUCTS

The present invention is directed to a method for enhancing the strength of cellulosic paper products without significant adverse effect on their repulpability. It is also directed to the novel resulting products. It is particularly applicable but not limited to products in which significant amounts of secondary fiber are used in the furnish.

BACKGROUND OF THE INVENTION

Paper mills through the country are presently using increasing amounts of secondary fiber in their products. This has in part resulted from more efficient collection of waste paper products, e.g., by businesses and by curbside recycling, and in part from improved technology-that has enabled acceptable primary products to be made from what were formerly waste products. An additional impetus has come following the realization that well over half of the volume of waste going into municipal landfills was paper-based. There has been significant political and environmental pressure to reduce this volume. Many customers and consumers now demand paper products with a significant amount of post-consumer recycled fiber.

Unfortunately, each time cellulosic fibers are recycled there is some loss in strength. This is in part due to fiber breakage and cutting during the repulping process and from subsequent refining. In part it is due to the inherent nature of the fiber itself Fiber once dried from an aqueous system suffers an inherent and irreversible morphological change that affects subsequent fiber-to-fiber bonding. For any given paper type; e.g., papers of identical basis weight and additives, products made from recycled fiber of the same type will typically be approximately 30% lower in selected strength properties than the same product made from virgin fiber. Mills are then forced to compensate by making products of higher basis weight, by using additives to increase lost strength, by increased refining, or by some combination of these methods. The result is a higher cost product that is often less competitive with a similar product made from primarily virgin fiber.

Certain additives are commonly used to augment wet and dry strength. Cationic starches have long been used in linerboard to increase dry strength. Small quantities; e.g., 0.1–0.7%, of cationic polyamide-epichlorohydrin reaction products (PAE resins) are well known to increase both wet and dry strengths. They are routinely used in products such as facial tissues and paper towels. They are also used in a small percentage of the linerboard used for the manufacture of wet strength-type corrugated board products. Tissue and towels normally do not enter the recycle stream although much of the wet strength corrugated board does. There it presents a problem because of very poor repulpability. This is normally tolerable since typically not more than about 1% or 2% of the corrugated board produced for the marketplace has received this type of wet strength treatment. However, if significantly larger quantities of PAE treated products were in the recycle stream waste from screening repulped fiber would increase substantially and production rates would be adversely affected. Thus, despite their known efficiency at increasing both dry and wet strength, PAE resins have been very selectively used only for specific products where their poor repulpability does not present a significant problem. However, PAE and other wet strength resins have not heretofore been considered as suitable for general use in increasing strength of the huge volumes of cellulosic paper products that will return to enter the recycle stream. While it is known that repulpable wet strength resins are at a developmental stage these products have not yet achieved any significant commercial use.

SUMMARY OF THE INVENTION

The present invention describes a method by which PAE resins and other types of papermaking additives normally used for imparting wet strength may be used for increasing dry strength and other properties of papers without adversely affecting repulpability. The method involves separating from about 5–40% of the fiber from the bulk of the furnish. This is treated in aqueous suspension with about 0.5–5.0% by weight of a cationic crosslinking type wet strength resin additive and held for a sufficient period of time for the resin to attach or bond to the fiber surface. It is then recombined with the untreated bulk of the furnish and thoroughly and uniformly mixed with it. From this point the mixed furnish is sheeted and dried in the normal manner.

It is essential that the resins employed are sufficiently cationic to permit ionic bonding to anionic sites on the cellulose fibers. It is further necessary that they be types that will chemically crosslink. Crosslinking normally occurs in the dryer section of the paper machine and will usually continue for some time thereafter. These are characteristics of all the commercially available resins intended for wet strength development. Examples are the cationic polyamide-epichlorohydrin (PAE) resins noted earlier, as well as cationic urea-formaldehyde (UF) and melamine-urea-formaldehyde (MUF) condensation products. The PAE resins are preferred because they are useable over a relatively wide pH range, up to about pH 8–8.5, while the others must be used under acidic conditions. Many of the paper products now being made use alkaline sizing and the UF and MUF resins are not compatible with the alkaline systems.

A preferred range of fiber diverted for the cationic resin pretreatment is about 10–30%. Repulpability tends to suffer somewhat when more or less fiber is pretreated. The hold time for reaction of the resin with the fiber need not be long. At least 30 seconds is usually required and longer times, preferably in the range of 5 minutes to an hour, are preferred. A sufficient amount of resin is used with the pretreated fiber to achieve about 0.1–0.6% by weight usage in the ultimate product. More typically 0.2–0.4% would be used.

The invention is believed operable with any of the many paper types commercially made. While it is particularly useful in increasing strength of papers containing significant amounts of secondary fiber, there are instances when it can be used to advantage with products made of all virgin fiber. Normally, strength enhancement will not be as great with virgin fiber products as with those using significant amounts of recycled fiber. The method is particularly useful when the furnish is totally secondary fiber. Preparation of unbleached linerboard for corrugated container board is expected to be a major application. However, other uses with bleached fine papers and newsprint also appear to be attractive. The method appears to be equally applicable where there are significant amounts of mineral additives; e.g., fillers or pigments, present in the papermaking furnish.

By virgin fiber is meant a predominance of cellulosic fiber that has never been dried after the pulping process. It will be understood that small amounts of previously dried fiber may be included since low percentages; e.g., usually no more than about 1–5%, of mill broke such as trimmings, scrap from sheet breaks, and off specification material, are almost always reworked into otherwise virgin material. By secondary fiber is meant fiber that has been at least once dried. Recycled material is always considered to be secondary fiber, whether from post consumer sources or various internal mill sources.

As was noted, the method enables improvement of dry strength properties without any serious adverse effect on repulpability. Although it is not the primary goal of the invention, there will also normally be some increase in wet strength as well. In some products this may be quite significant. When the entirety of the stock is treated with the cationic resins in the usual manner, similar dry strength improvements occur as well as the desired wet strength improvement. Unfortunately, repulpability suffers very significantly. This has, in the past, inhibited the use of the crosslinking cationic resins to very specific applications where increased wet strength was the paramount property gain required. However, for the great bulk of the paper products produced dry strength is the property considered most essential. High wet strength for these products is not of significant importance.

There are a number of secondary but very significant advantages that accrue with the use of the invention. Creep resistance in corrugated board is noticeably improved. This is of considerable importance when corrugated shipping containers are stacked one on the other in a warehouse or other environment in which there are wide and cyclic fluctuations in humidity. Refining level can also be reduced somewhat, resulting in lower energy costs and higher mill productivity. The potential is present for the use of higher percentages of secondary fiber in many products where this usage is now limited. As was noted before, a reduction in basis weight while maintaining equivalent strength is of considerable economic importance.

It is possible to place general numerical values on the advantages realized by use of the method. While these numbers will differ somewhat for different products, to use unbleached linerboard made with recycled fiber as an example, an improvement of 5–15% in short span compressive strength (STFI) is typical. A 25–30% improvement in creep resistance and up to 30% improvement in mullen burst are frequently realized. This is accomplished with only about 2–3% or less screening rejects on repulping. Basis weight can frequently be reduced up to about 10% compared with sheets made from untreated fiber.

It is an object to provide a method for increasing dry strength of cellulosic paper products that will not result in a significant increase in screening rejects upon reuse as secondary fiber.

It is another object to provide products containing significant amounts of secondary fiber that approach the same strength properties as equivalent products made from virgin fiber.

It is a further object to provide a method whereby products of equivalent dry strength can be made at lower sheet basis weight.

It is yet an object to provide a method whereby refining energy can be reduced.

These and many other objects will become readily apparent upon reading the following detailed description taken in conjunction with the drawings.

DETAILED DESCRIPTION OF THE PREFERRED EMBODIMENTS

Figure 1:
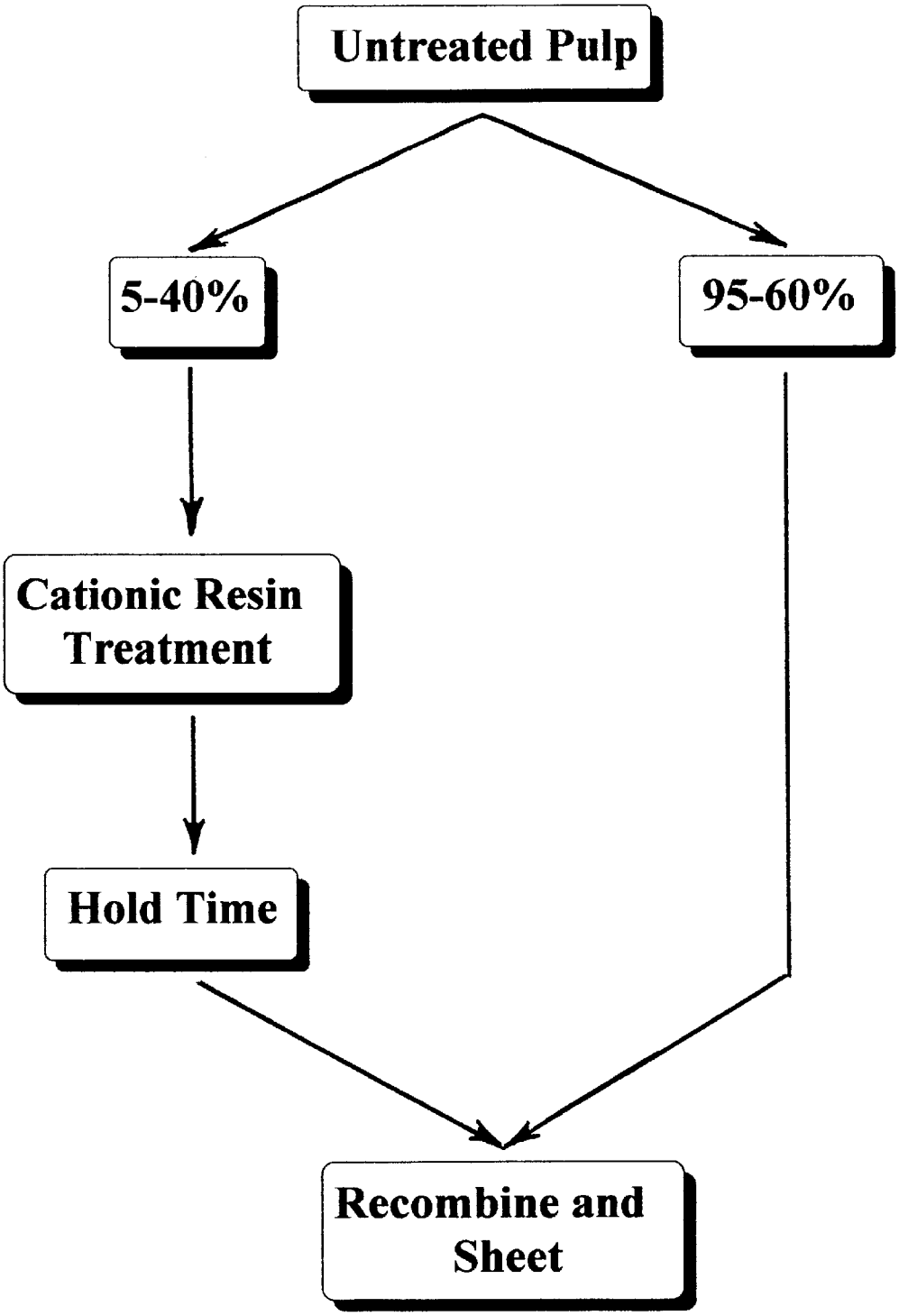
FIG. 1 is a block diagram showing the process of the present method.

Before describing the invention in detail brief comment will be made on the methods used. Where handsheets were prepared, they were made by running about 50 g of fiber through a Valley Beater refiner to the desired freeness as measured by the Canadian Standard Freeness (CFS) test. Consistency was then adjusted to 0.3%. Handsheets were then made conventionally using a Noble and Wood sheet mold that produced sheets 203×203 mm. Formed sheets were pressed initially on a pneumatic press at 275 kPa. This was followed by a second pressing at approximately 690 kPa to achieve linerboard density. This then was followed by two passes through a drum dryer rotating at approximately 4 minutes per pass. Prior to testing sheets were conditioned by a standard Tappi procedure including initial exposure to an atmosphere of 20% R.H. and 20° C. followed by 24 hours at 50% R.H. and 20° C.

Standard test methods were used when appropriate. However, there are no such methods available for measuring repulpability and creep. The methods developed for evaluating these properties will be described.

Repulpability Test

For determining repulpability the product to be tested was cut into strips about 13×150 mm and a 25 g air dried sample of the strips was used. The sample was soaked for 30 minutes in 1500 mL of water at 60° C. and stirred in a large blender on low speed for 4 minutes. The blender was equipped with a clover leaf impeller lacking sharp edges. The mixture was then transferred to a British Disintegrator with 500 mL rinse water and run for 5 minutes. This suspension was then screened on a Valley flat screen having 0.006 inch (0.15 mm) slots and a drain connected to a 100 mesh screen box. Residual material on the screen was collected, placed in an aluminum dish and dried at 105° C. for 24 hours. Dried samples were then weighed and percent rejects calculated. While the test does not give identical results in absolute terms to those found in a given mill there appears to be an excellent correlation.

Creep Test

Constant load edgewise creep in a changing humidity environment is determined by first forming a test cylinder 1 inch (25.4 mm) in diameter and 1 inch high from a strip 78 mm in the machine direction and 50 mm in the cross machine direction The samples are preconditioned 24 hours at 20% R.H. and 23° C. and then conditioned and stored until use at 50% R.H. and 23° C. Four samples are wrapped and held around a 44.5 mm (1.75 inch) mandrel for 16 hours to facilitate cylinder construction. The strips are then wrapped around a 24.8 mm fluorocarbon mandrel to form the test cylinders. Edge deformation is prevented by gluing stainless steel rings outside the cylinder ends so as to leave the 25.4 mm test specimen. Test cylinders have glueless seams that require additional support. This is provided in part by an inner fluorocarbon plastic support 0.962 inches (24.4 mm) in diameter. The outside of the seam is opposed by a restraint system consisting of a fluorocarbon plastic block with a 0.5 inch (12.7 mm) radius face, an aluminum plate, and two extension springs. The fluorocarbon block has slots machined at a 45° angle across the face to facilitate moisture absorption In the test cylinder, moisture absorption occurs at the outer surface. Completed specimens are conditioned in the test fixture at 40% R.H. and 23° C. for i6–17 hours prior to testing. Cylinders are then loaded at 1.92 lb/inch of length (10.25N·m/m). The relative humidity test cycle consists of a 60 minute ramp up to 93% R.H. and 3 hour hold then a 60 minute ramp down to 40% R.H. and a 3 hour hold. Standard test length was 7 days or 21 full cycles. A non-contact transducer measures sample displacement so that a strain vs. time curve may then be plotted.

Ring Crush

Ring crush is run by TAPPI Test Method T 818 om-87. A 12.7×152.4 mm strip is formed into a cylinder 49.2 mm in diameter. This is placed in a grooved sample holder and top to bottom compression is applied between parallel plates until failure occurs.

Short Span Compression Test

This test is run by Tappi Test Method T 826 pm-92. It is considered by some authorities in the field to give data similar to that of the ring crush test and can be closely related to the compressive strength of corrugated containers. It is intended for containerboard having a span to thickness ratio of 5 or less. This is approximately equivalent to sheets having a grammage of at least 100 g/m$^2$ and not much exceeding 439 g/m$^2$(20.5–90 lb/msf). Test specimens 15 mm wide are gripped between clamps with an initial free span between the clamps of 0.70 mm. During the test the clamps are moved toward each other at a rate of 3±1 mm/min and load at failure is recorded. Typically a minimum of 10 tests are run in each machine direction, although machine direction is not a criterion for handsheets.

EXAMPLE 1

The process of the present invention is outlined on FIG. 1. Untreated pulp furnish to be sheeted is split into two portions. The portion to be pretreated will comprise about 5–40%, preferably 10–30%, of the total furnish. The balance of the furnish is handled conventionally. A cationic crosslinking wet strength resin is then added to the portion diverted to be pretreated in an amount of about 0.5–5.0%. The exact amount used will depend somewhat on the particular percentage of the total fiber being pretreated. In general it should be sufficient to comprise about 0.1–0.6% of the total furnish weight. After a hold time of at least about 30 seconds, preferably about 5 minutes or greater, the pretreated portion is then recombined with the untreated portion of the furnish and thoroughly mixed. From this point the recombined furnish is handled conventionally in all respects.

Four cationic papermaking chemicals were chosen for comparison using the conventional method in which all of the fiber was treated. One was a cationic starch, a product frequently applied internally to enhance dry strength. Another was a low molecular weight polyacrylamide, a product also intended for dry strength enhancement and typically applied internally. The other two materials were polyamide-epichlorohydrin (PAE) resins intended for wet strength improvement. These resins were similar to each other but were the products of different suppliers. The pulp treated was a once dried unbleached western softwood kraft intended for linerboard production. In all cases 100% of the pulp was treated using 0.25% or 0.50% of the additive. No white water was used in preparation of the subsequently made handsheets. The following table shows ring crush values obtained on the various samples after conditioning.

TABLE 1

Effect of Various Cationic Resins on Dry Ring Crush Values and Screening Rejects

| Resin Type | Resin Usage, % | Ring Crush, kN/m | Repulping Rejects, % |
|---|---|---|---|
| Cationic Starch | 0.25 | 2.31 ± 0.08[1] | — |
| Cationic Starch | 0.5 | 2.36 ± 0.10 | — |
| Polyacrylamide | 0.25 | 2.21 ± 0.19 | — |
| Polyacrylamide | 0.5 | 2.47 ± 0.11 | — |
| PAE #1[2] | 0.25 | 2.63 ± 0.13 | 44 |
| PAE #1 | 0.5 | 2.70 ± 0.10 | 64 |
| PAE #2[3] | 0.25 | 2.83 ± 0.10 | 41.4 |
| PAE #2 | 0.5 | 2.84 ± 0.13 | 57.5 |
| Recycled fiber Control | — | 2.22 ± 0.04 | — |
| Virgin Fiber Control | — | 3.04 ± 0.06 | — |

[1]90% Confidence limits
[2]Supplier #1
[3]Supplier #2

Exemplary cationic PAE resins can be obtained From Hercules, Inc., Wilmington, Del., as Kymene® 557H, or from Georgia Pacific Corp., Atlanta, Ga., as Amres® 8855. This is not intended as an endorsement of these particular resins as equally suitable resins may be available from other suppliers.

With the exceptions of the samples having the lower usages of the cationic starch and polyacrylamide resins, all of the treated samples had statistically significant superior ring crush values to an untreated once dried control sample. The PAE treated samples were clearly superior to those made using the cationic starch and polyacrylamide. None of the treated samples reached the value of the never dried virgin fiber sheets. However, the dry strength improvement of the PAE treated samples, as measured by ring crush, compared to the results obtained from untreated once dried fiber was quite dramatic. Repulping rejects on all of the PAE treated samples exceeded 40%. While repulping rejects were not determined on any but the PAE resin treated samples, experience would indicate that screening rejects on all of the others should be very low, normally about 2% or less Thus, while the PAE resins used conventionally as above contribute significant dry strength improvement the resulting high repulping screen rejects makes the treatment unsuitable for general use.

EXAMPLE 2

The previous conventional treatment with PAE resins described in Example 1 was compared with that of the present invention. Sheets were prepared from once dried western softwood kraft fiber without any treatment, with 100% being treated, and with 10% being pretreated with PAE resin then recombined with the 90% untreated fiber. Resin usage was 2.5% by weight on the fiber pretreated, resulting in 0.25% total usage on the recombined fiber.

TABLE 2

Effect of Pretreatment on Short Span Compressive strength and Screening Rejects

| Fiber Treatment[1] | Short Span Compression Strength, kN/m | Screening Rejects,[1] |
|---|---|---|
| No resin treatment | 4.08 ± 0.19[2] | <1 |
| All fiber treated[3] | 5.06 ± 0.44 | 22.9 |
| 10% pretreated[4] | 4.82 ± 0.21 | 2.8 |

[1]Once dried fiber sheeted from fresh water, 161 g/m$^2$ sheet weight
[2]90% Confidence limits
[3]0.25% PAE resin used on treated fiber
[4]0.25% PAE resin used based on total recombined fiber It is evident that a significant improvement in dry strength was obtained on the two samples treated with the PAE wet strength resin. However, repulpability of the sample in which all of the fiber had been treated was very poor with about 23% screening rejects. The dry strength of the other sample was slightly lower but screening rejects were below 3%. Thus, the pretreated sample had an 18% improvement in dry strength with only a minimal increase in rejects when compared with the untreated sheets.

EXAMPLE 3

Figure 2:
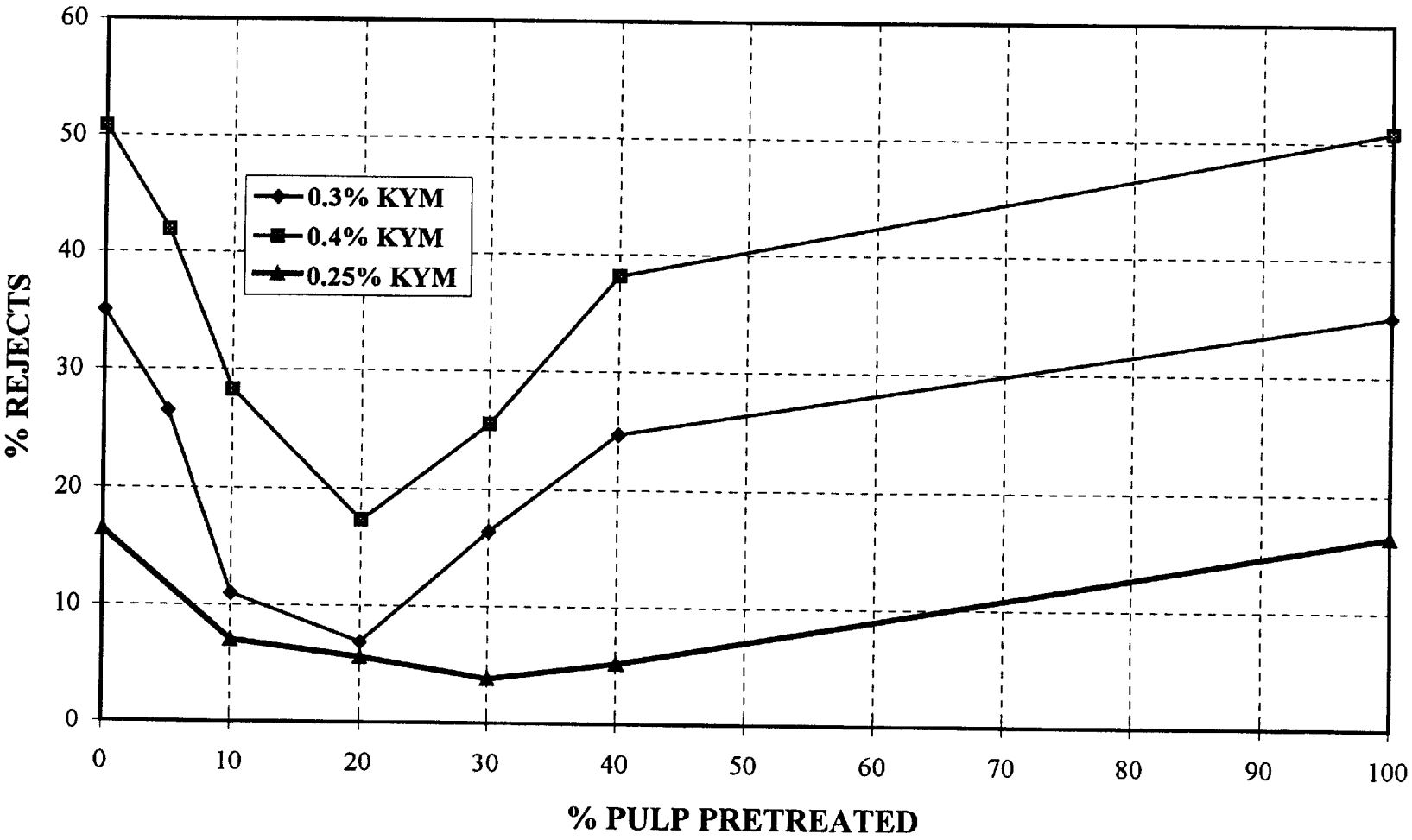
FIG. 2 is a graph showing percent screen rejects vs the percent of pulp pretreated at three levels of cationic resin usage.

The amount of the fiber to be pretreated with the cationic wet strength resin can vary widely. Specific amounts will be determined in part by the particular environment in the mill in which the process is carried out. From about 5% to 40% gives generally satisfactory results. However, there is a broad optimum from the standpoint of minimizing screen rejects on repulping in the range of about 10% to 30% of the fiber pretreated. Again, the fiber was once dried western softwood kraft intended for ultimate use as linerboard. This is shown graphically in FIG. 2 for treatment levels of 0.25%, 0.30%, and 0.40%, based on total recombined furnish. A cationic PAE wet strength resin was used in all cases. For the two higher levels of use a marked minimum amount of repulping rejects is noted at a pretreatment level of about 20%. The effect does not appear as dramatic for the lower level of PAE use While the present inventors do not wish to be bound to any particular reason for this behavior, the following explanation is suggested. When only small amounts; e.g., 5% of the pulp is pretreated there appears to be an excess amount of cationic resin for attachment at available anionic sites on the fiber. The excess remains free and is then available for reaction with the fiber that had been withheld when the two portions are recombined. Stated otherwise, the pretreated fiber is treated with the resin to saturation, but the entire balance of the fiber is also treated, albeit to a lower degree. In effect, the entire product has had wet strength treatment. As would be expected, the effect is more noted as the amount of resin used in pretreatment is increased. At the high end of pretreatment, e.g., about 40%, so much of the fiber has been reacted with the resin that the ultimate product will also have achieved an excessively high initial level of wet strength so that repulpability suffers. It must be kept in mind that improved dry strength with good repulpability is the goal of the invention. It is not a primary purpose to produce a product having good wet strength. Means to do that are well known. However, as was noted earlier, an inevitable corollary of wet strength papers made with current practice is that they will have inherently poor repulpability.

Figure 3:
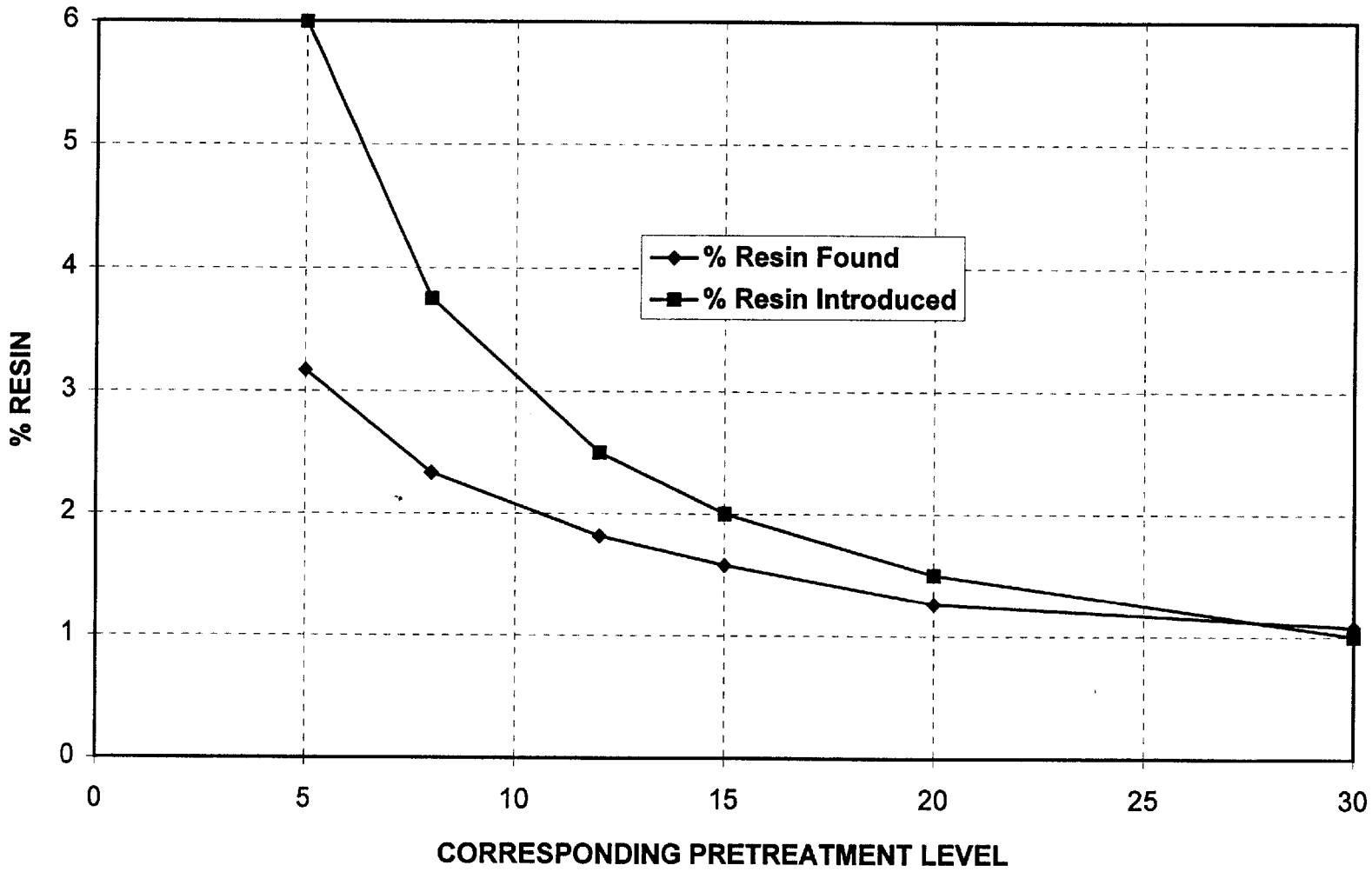
FIG. 3 is a graph showing the amount of cationic resin retained vs the amount of resin introduced at various pretreatment levels.
Figure 4:
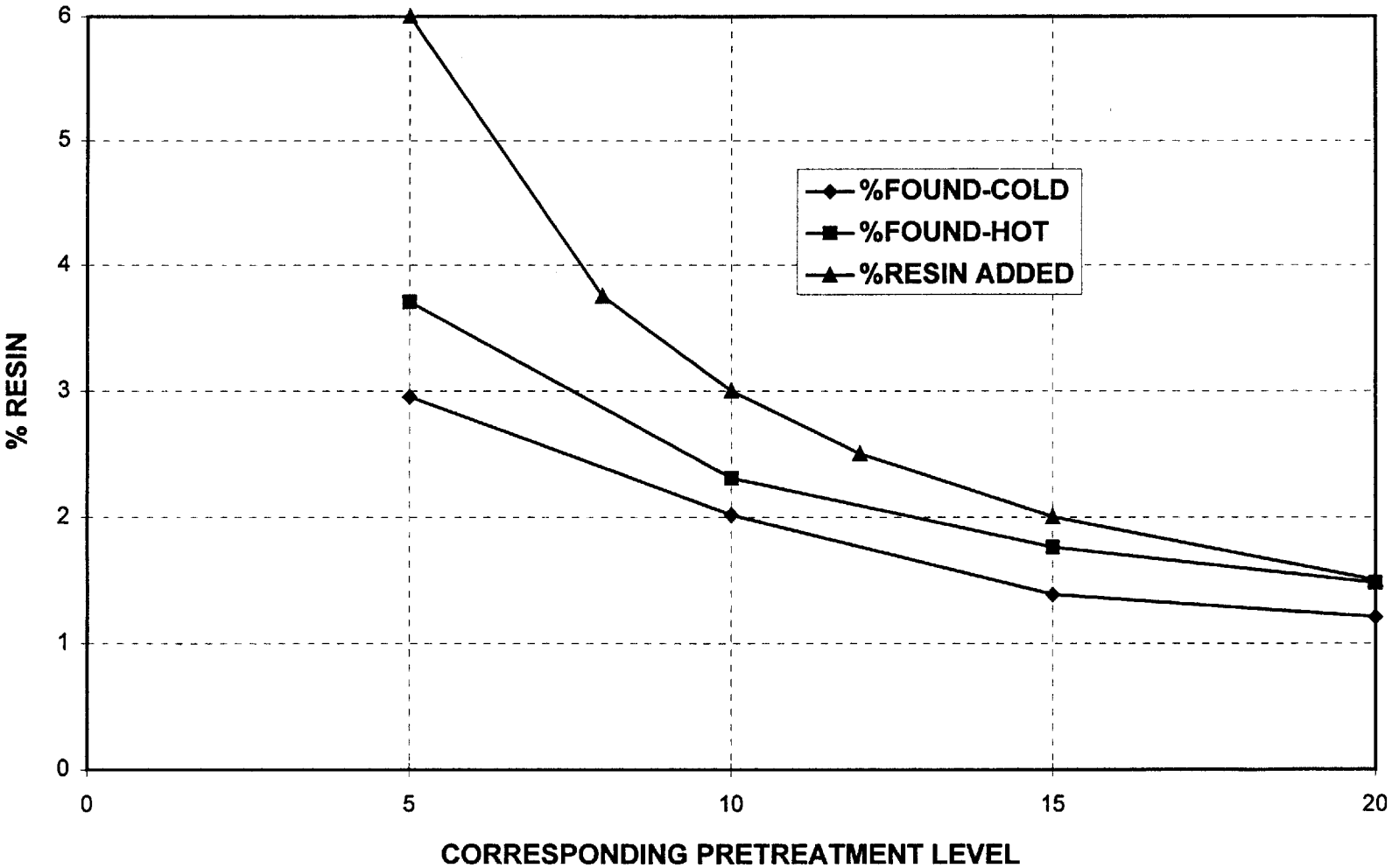
FIG. 4 is a graph showing the effect of pretreatment temperature on cationic resin retention.

Support for the above suggested mechanism is shown by work pictured graphically in FIGS. 3 and 4. Once dried fiber was treated with a cationic PAE wet strength resin in amounts varying between 1% and 6%. These amounts would be equivalent to the resin required at various pretreatment levels in order to achieve 0.3% in the recombined product. After a 5 minute hold time handsheets were made in the usual manner. The resulting sheets were analyzed for nitrogen using the Kjeldahl method and the measured nitrogen content related to the amount of original resin present. FIG. 3 shows that at a very high 6% initial resin usage, corresponding to a 5% pretreatment level, almost half of the original resin is lost in the white water during sheeting. This would have been available to the untreated fiber after the two portions were recombined. At only 1% initial usage, equivalent to a 30% pretreatment level, virtually all of the resin was bonded to the fiber.

Treatment temperature also affects resin retention somewhat with higher temperatures tending to increase retention. All pulp slurries in the study shown in FIG. 3 had been made using approximately room temperature water. Since warm to hot water is commonly used in paper mills at the sheet former a second study was made comparing resin retention in 60° C. water with the approximately 20° C. water used previously. As seen in FIG. 4 retention is improved somewhat at all resin usages although this effect is not dramatic.

EXAMPLE 4

Pretreatment retention time is another variable with some effect on the improvement noted in dry strength of the ultimate product. This factor is another that will be influenced somewhat by individual mill configurations. However, suitable products can normally be made with as little as 30 seconds hold time before the pretreated fiber is recombined with the balance of the furnish. Somewhat longer times are preferred,. Normally the hold time after pretreatment should be at least 5 minutes. A small additional effect is seem when holding times are increased to 1–2 hours but little or no further benefit is obtained when holding times are longer than this. The effect of pretreatment time on the amount of screening rejects and short span compression strength is given in the following table.

The mechanism affecting pretreatment time variables is believed to be similar to that just offered in explanation for the optimum amount of fiber to be pretreated. Reaction of the cationic resin with the fiber takes a finite amount of time. When pretreatment times are very short it is probable that complete reaction has not occurred. This will result in unreacted resin being carried over when the pretreated stock is blended with the balance of untreated material. The unreacted resin portion is then free to react in a manner as if it had initially been added to all of the stock.

TABLE 3

Effect of Pretreatment Hold Time

| Hold Time After Treatment[1] | Amount of Total FiberTreated | Screening Rejects, % | Short Span Compression Strength, kN/m |
|---|---|---|---|
| 5 min | 100% | 27.4 | — |
| 5 min | 20% | 6.7 | 3.48 ± 0.067[2] |
| 1 hr | 100% | 26 | — |
| 1 hr | 20% | 1.3 | 3.64 ± 0.097 |
| 2 hr | 100% | 34.3 | — |
| 2 hr | 20% | 2.7 | 3.76 ± 0.046 |
| 4 hr | 100% | 26.5 | — |
| 4 hr | 20% | 1.6 | 3.75 ± 0.163 |
| 24 hr | 100% | 24.2 | — |
| 24 hr | 20% | 0.7 | 3.60 ± 0.092 |
| No treatment | — | <1 | 3.46 ± 0.093 |

[1]Fiber was mid-continent recycled corrugated containers sheeted using recycled white water. Resin usage was 0.3% PAE based on total fiber weight.
[2]90% Confidence limits.

Screening rejects were essentially unchanged throughout when all of the fiber was treated. After 5 minutes pretreatment time this was also the case when 20% of the fiber had been pretreated prior to recombination with the balance of the untreated fiber. The improvement in short span compression strength seen in the sheets made according to the teaching of the present invention is statistically significant.

EXAMPLE 5

One of the very important advantages of the present invention is that the method permits a reduction in sheet basis weight while maintaining dry strength equivalent to products made conventionally using a significant percentage of recycled fiber. This is seen in the data presented in the following table

TABLE 4

Effect of Sheet Basis Weight Reduction on Short Span Compression Strength Using PAB Resin Pretreatment Process

| Fiber Treatment[1] | Relative Basis Weight | Short Span Compression Strength, kN/m |
|---|---|---|
| Control, no resin treatment | 100% | 2.71 |
| Control, no resin treatment | 90% | 2.44 |
| 100% of fiber PAE treated[2] | 90% | 3.12 |
| 10% of fiber PAE treated[3] | 90% | 3.06 |

[1]Recycled once dried fiber sheeted with clean water
[2]0.25% PAE resin based on total fiber
[3]Sufficient PAE resin used in pretreated portion to give 0.25% based on total recombined fiber Even with a 10% reduction in basis weight the short span compression strength of the product made with pretreated fiber exceeded that of the control sample. While the percentage of screening rejects was not determined on these samples it would be consistent with those shown in the samples of FIGS. 3 and 4.

EXAMPLE 6

One more advantage of the process of the present invention is that it enables achievement of a given level of dry strength at a reduced level of refining. Refining is a major energy consumer in a paper mill. Any means by which it can be reduced will represent a significant cost savings in paper production costs. Sheets made from a fiber obtained from recycled corrugated containers were made with and without resin pretreatment at three refining levels. In the examples of pretreated fiber, 20% of the furnish was treated with 1.5% PAE resin, sufficient to achieve a level of 0.3% in the recombined pulp. Results are given in following Table 5.

TABLE 5

Effect of Refining on Short Span Compression Strength

| Fiber Treatment | Freeness, CSF | Short Span Compression Strength, kN/m | Strength Enhancement, % |
|---|---|---|---|
| Control, no resin treatment | 608 | 3.43 ± 0.10[1] | — |
| 20% Pretreated[2] | 608 | 3.82 ± 0.13 | 11.4 |
| Control, no resin treatment | 508 | 3.96 ± 0.09 | — |
| 20% Pretreated[2] | 508 | 4.19 ± 0.14 | 5.8 |
| Control, no resin pretreatment | 468 | 4.11 ± 0.14 | — |
| 20% Pretreated[2] | 468 | 4.22 ± 0.13 | 2.3 |

[1]90% Confidence limits
[2]Sufficient PAE resin used to give 0.3% based on recombined fiber It is evident at all freeness levels that the short span compression strength of the pretreated samples is significantly higher than the samples without any resin treatment. Thus, for any required level of strength, a lower degree of refining will suffice for the sheets made using the pretreatment process.

Burst strength was at one time a major test for evaluating material for corrugated containers. Recently emphasis has been directed more to tests that will be indicative of top-to-bottom compression strength such as ring crush and short span compression strength. However, burst strength is still a property considered extremely important by many customers. In the following test fiber from recycled corrugated containers was continuously sheeted on a Noble and Wood pilot scale paper machine. Wet and dry burst strength was determined among the other tests that were run. In those samples made according to the present invention 20% of the fiber was pretreated with 2.25% PAE resin by weight, sufficient to achieve a level of 0.45% in the recombined furnish.

Mill white water typically contains fine particles from broken fibers and other papermaking materials of an anionic nature which are collectively referred to as "anionic trash". Depending on the particular mill and furnish being processed, it is sometimes necessary to use a cationic charge neutralizer so that this material does not itself remove and reduce the efficiency of subsequent cationic additives intended as fiber substituents. These charge neutralizers are quite conventional papermaking chemicals. Other than improving efficiency of other cationic additives they effect little or no change in properties of the paper itself As noted in the following table, they were used in the quantities listed in preparation of the test samples. All samples were made to equivalent basis weights.

TABLE 6

Effect of PAE Resin Pretreatment on Wet and Dry Burst Strength at Different Refining Levels

| Sample No. | Fiber Treatment[1] | PAE Resin Used, % | Test Conditions | Mullen Burst,[5] kPa |
|---|---|---|---|---|
| 1[2] | Unrefined Control | None | Wet | 190 |
| 2 | Unrefined Control | None | Diy | 312 |
| 3 | Unrefined - treated[3] | 0.45 | Wet | 250 |
| 4 | Unrefined - treated | 0.45 | Dry | 399 |
| 5 | Control refined to 520 CSF | None | Wet | 219 |
| 6 | Control refined to 520 CSF | None | Dry | 401 |
| 7 | Treated - Refined to 520 CSF | 0.45 | Wet | 251 |
| 8 | Treated - Refined to 520 CSF | 0.45 | Dry | 421 |
| 9[4] | Control refined to 520 CSF | None | Wet | 216 |
| 10 | Control refined to 520 CSF | None | Dry | 416 |
| 11 | Treated - Refined to 520 CSF | 0.45 | Wet | 250 |
| 12 | Treated - Refined to 520 CSF | 045 | Dry | 440 |

[1]Fiber for all samples was recycled corrugated containers
[2]Samples 1–8 sheeted with 50% white water and 0.1% high charge density cationic resin used as anionic "trash" scavenger
[3]20% of fiber treated with sufficient PAE resin to give 0.45% based on total recombined fiber
[4]Samples 9–12 sheeted with clean water and 0.05% high charge density cationic resin used as aniomc "trash" scavenger
[5]Tappi Method T807 om-94

It is readily evident that in every case both wet and dry burst strength of the pretreated samples was superior to that lacking the PAE resin pretreatment of 20% of the furnish.

EXAMPLE 7

In present mill practice it is quite common for linerboard furnish to be a mixture of virgin and recycled fiber; e.g., old corrugated containers and other recycled paper products. As was noted earlier, the improvement in dry strength imparted by the process of the present invention is more marked with recycled fiber than with virgin fiber. However, dry strength improvements are seen in products made from all virgin fiber as well as in mixtures as the following table will show.

TABLE 7

Effect of Virgin/Recycled Fiber Ratio on Short Span Compression Strength

| Virgin Fiber in Furnish, %[1] | Fiber Treated with PAE Resin, %[2] | Short Span Compression Strength, kN/m | Strength Enhancement, % |
|---|---|---|---|
| 100 | 0 | 4.47 ± 0.09[3] | — |
| 100 | 20 | 4.76 ± 0.11 | 6.5 |
| 90 | 0 | 4.25 ± 0.08 | — |
| 90 | 20 | 4.66 ± 0.11 | 9.6 |
| 70 | 0 | 3.98 ± 0.11 | — |
| 70 | 20 | 4.50 ± 0.10 | 13.1 |
| 50 | 0 | 3.77 ± 0.13 | — |
| 50 | 20 | 4.34 ± 0.07 | 15.1 |
| None | 0 | 2.74 ± 0.06 | — |
| None | 20 | 3.52 ± 0.09 | 28.5 |

[1]Balance of fiber is recycled corrugated containers
[2]Sufficient PAE resin used in all cases to give 0.3% based on total fiber
[3]90% Confidence limits While improvement in short span compression strength using the PAE pretreatment is seen in all pairs, the magnitude of improvement becomes significantly greater as the amount of recycled fiber in the furnish is increased.

EXAMPLE 8

One cause of failure of corrugated containers is creep, the gradual top-to-bottom slumping encountered when stacked filled containers are subject to cyclic temperature and humidity change. Wet strength treated board is resistant to creep but, as was noted earlier, is difficult to repulp without significant screening loss. The fiber used for the following tests was western softwood kraft. Material used for the tests was fiber from old corrugated containers. Even though it is not intended to achieve improved wet strength, as will be seen in the following table the treatment of the present invention effects a significant improvement in creep resistance.

TABLE 8

Effect on Creep Rate Using Resin Pretreated Fiber

| Fiber Treatment[1] | Secondary Creep Rate, Creep Strain/day[2] |
|---|---|
| No resin treatment | 0.00179 ± 0.00066 |
| All fiber treated[3] | 0.00114 ± 0.00037 |
| 20% Pretreated[4] | 0.00133 ± 0.00043 |

[1]Recycled corrugated container fiber
[2]Based on 12 tests
[3]0.3% resin used based on total fiber
[4]0.3% resin used based on total recombined fiber

EXAMPLE 9

The earlier examples were primarily directed to paper products such as linerboard for corrugated containers. Little or no mineral fillers are present in these papers. This is not the case with so-called fine papers and many other paper products. These normally have filler contents up to about 20% by weight. In some papers filler content may be much higher. Fillers are used to contribute smoothness and opacity and to reduce cost since they are usually less expensive on a volume basis than virgin cellulose fiber. As filler content increases strength normally decreases due to interference of the filler particles with the interfiber bonding mechanism. The most usual fillers are kaolin clays or precipitated calcium carbonate. Both are anionic materials which are frequently chemically modified by the suppliers to have specialized surface characteristics for particular grades of paper.

Printing qualities of fine papers are influenced not only by the fillers present but by sizing and subsequent surface treatment. Many are treated with starch at the size press. However, the type and location of the size press affect the z-direction distribution of starch into the sheet. Starch distributed across the thickness contributes significant internal bond strength to the sheet. However, if Z-direction strength could be improved otherwise starch could be concentrated near the sheet surface where it would have the most beneficial effect on print quality.

A very significant percentage of fine papers enter the recycle stream. The fiber is subject to the same deterioration in strength noted earlier for recycled corrugated containers. Thus some means of improving paper strength other than by starch additives would be very beneficial. The process of the present invention provides such a means.

Handsheets were prepared using a western bleached pulp with a 65:35 weight ratio of hardwood to softwood fiber. To this was added 20% by weight of scalenohedral precipitated calcium carbonate and 0.38 kg/t of a cationic retention aid. Cationic potato starch was also added at a rate of 5 kg/t. The furnish was divided into portions and 2.25% by weight cationic PAE resin was added to 20% of the stock. This was sufficient to achieve 0.45% by weight of the entire solids in the furnish. In one sample the PAE resin was added prior to addition of the other additive materials and in another sample the PAE resin was added subsequently. Results are seen in the table that follows. Scott bond is a measure of the internal bond of the sheet.

TABLE 9

Effect of Cationic PAE Resin Addition Point on Scott Bond Strength

| PAE Resin Addition Point | Scott Bond, J/m[2] | Standard Deviation |
|---|---|---|
| Control - no PAE resin | 221.71 | 9.77 |
| Added to fiber before other additives[1] | 233.27 | 19.01 |
| Added after starch, filler and retention aid[1] | 326.57 | 24.05 |

[1]All of he PAE resin was added to 20% of the furnish in am amount to give 0.45% based on the recombined fiber and filler
[2]Tappi Method UM 403

A second experiment was conducted in which only the second condition was examined; i.e., PAE resin added to 20% of the furnish only after all other additives. A number of other properties were evaluated as shown in Table 10.

TABLE 10

Effect of Cationic PAE Resin Pretreatment on Paper Physical Properties

| Condition | Scott Bond, J/m² | Z-Direction[2], kpa | Tensile Index[3], N · m/g | Total Energy Absorption[3], J/m² | Ash, % |
|---|---|---|---|---|---|
| No PAE resin used | 258.06 | 492.99 | 32.50 | 0.734 | 18.7 |
| 20% treated[1] | 347.59 | 557.34 | 44.42 | 1.18 | 18.7 |

[1]20 % of the furnish was treated with sufficient PAE resin to give 0.45% based on the recombined weight of fiber and filler
[2]Tappi Method TM 541 om-89
[3]Tappi Method TM494 om-88

It is seen that in all cases the properties were significantly improved using the pretreatment process of the invention.

EXAMPLE 10

Along with dry strength improvement, it has been noted that there is often a significant improvement in wet strength as well. This was apparent in the data of Table 6 but is seen better in the following test. Recycled east coast corrugated containers were repulped and treated with PAE resin at a level of 0.4% based on total fiber. Resin treatment was carried out on 20% and 100% of the fiber at ambient temperature and at 49° C. The pulp was refined to a freeness of 500 csf prior to treatment. Pretreatment time was 5 minutes before recombination with the untreated fiber. Handsheets were prepared as described previously at 0.3% consistency using fresh water for pulp dilution. Basis weight was 200 g/m² and sheet density about 650 kg/m³. Both dry and wet tensile index were measured. Results of the tests are seen in the following Table.

TABLE 11

Effect of PAE Treatment on Dry and Wet Tensile Strength

| Sample | Fiber Treated, % | Treatment Temperature | Tensile Index, Dry, N · m/g[1] | Tensile Index, Wet, N · m/g[2] |
|---|---|---|---|---|
| Untreated | 0 | Ambient | 50.4 ± 1.0 | 2.4 ± 0.1 |
| Pretreated | 20 | Ambient | 55.7 ± 1.7 | 11.8 ± 0.5 |
| Stand&d | 100 | Ambient | 59.5 ± 2.4 | 27.9 ± 1.1 |
| Untreated | 0 | 49° C. | 51.6 ± 1.1 | 2.3 ± 0.2 |
| Pretreated | 20 | 49° C. | 57.7 ± 1.4 | 10.6 ± 0.6 |
| Standard | 100 | 49° C. | 57.2 ± 2.2 | 14.5 ± 0.7 |

[1]Tappi method T494 om-88
[2]Tappi method T456 om-87

Significant increases in both dry and wet strength are seen using the pretreatment process. For the pretreated fiber the the wet/dry ratio was 0.21 for the ambient temperature treatment and 0.18 for treatment at 49° C. The recognized standard for a wet strength sheet is a ratio of 0.15 or greater. Thus, for some furnishes the pretreatment process does provide a wet strength sheet even though the strength is somewhat lower than when 100% of the pulp is treated. While the test for screeing rejects was not run on the above samples, based on experience; e.g., Tables 2 and 3, screening rejects would be expected to be in the range of 2–3% for the pretreated sheets and 15+% for the sheets having 100% of the fiber treated.

The inventors have herein disclosed their best current mode of practicing their invention. However, it will be apparent to others skilled in the art that many variations can be made in the process parameters and the products so produced that have not been exemplified. Therefore it is the intent of the inventors that these variations should be included within the broad scope of the invention if encompassed within the appended claims.

We claim:

1. A method for making a readily repulped cellulosic fiber paper product which comprises:

separating from 5–40% of the fiber from the bulk of the fiber furnish;

treating the separated fiber in an aqueous suspension with 0.5–5.0% by weight of a cationic crosslinking-type wet strength resin additive for a sufficient time to permit bonding of the resin to the cellulosic fiber;

recombining and thoroughly and uniformly mixing the treated fiber with the untreated balance of the cellulosic fiber furnish in an aqueous slurry; and sheeting and drying the mixed treated and untreated fiber into a paper product at a temperature sufficient to achieve at least partial crosslinking of the resin additive whereby dry strength of the product is enhanced without adverse effect on repulpability.

2. The method of claim 1 in which 10%–30% of the fiber is treated with the cationic resin additive.

3. The method of claim 1 in which there is a delay time of at least 30 seconds after addition of the resin to the separated fiber to permit bonding of the resin to the fiber before it is recombined with the untreated fiber.

4. The method of claim 3 in which the delay time is between 30 seconds and one hour.

5. The method of claim 1 in which the crosslinking-type wet strength resin is selected from the group consisting of urea-formaldehyde condensation products, melamine-urea-formaldehyde condensation products, and polyamide-epichlorohydrin reaction products.

6. The method of claim 5 in which the chemically reactive resin is a polyamide-epichlorohydrin reaction product.

7. The method of claim 6 in which the polyamide-epichlorohydrin resin is used in an amount sufficient to attain 0.1–0.6% by weight based on the recombined fiber in the paper product.

8. The method of claim 1 in which the cellulosic fiber furnish is predominantly never before dried virgin fiber.

9. The method of claim 1 in which the cellulosic fiber furnish contains at least 5% recycled previously dried fiber.

10. The method of claim 7 in which the cellulosic fiber furnish contains 10–100% recycled previously dried fiber.

11. A cellulosic fiber paper product which comprises from 5–40% of the fiber treated with 0.5–5.0% of a reactive crosslinking-type wet strength resin additive uniformly blended with 95–60% of untreated fiber, said resin being at least partially crosslinked, the paper product having increased dry strength and having improved repulpability compared with a similar product in which all of the fiber has been treated with an equivalent amount of the resin.

12. The paper product of claim 11 in which from 10–30% of the fiber has been treated with the resin additive.

13. The paper product of claim 11 in which the resin is selected from the group consisting of urea-formaldehyde condensation products, melamine-urea-formaldehyde condensation products, and polyamide-epichlorohydrin reaction products.

14. The paper product of claim 13 in which the resin is a polyamide-epichlorohydrin reaction product.

15. The paper product of claim 11 which contains from 0.1–0.6% by weight of the resin based on the total amount of cellulosic fiber in the product.

16. The paper product of claim 11 which comprises predominantly never before dried virgin cellulosic fiber.

17. The paper product of claim 11 which comprises a mixture of never before dried virgin fiber at least 5% recycled previously dried fiber.

18. The paper product of claim 17 in which comprises a mixture containing from 90–0% never before dried virgin fiber and from 10–100% previously dried recycled fiber.

* * * * *